United States Patent [19]

Snellman et al.

[11] Patent Number: 4,561,647

[45] Date of Patent: Dec. 31, 1985

[54] SHEET DEFLECTOR AND CONVEYOR DRIVE

[76] Inventors: Donald L. Snellman, 2807 W. Galer St., Seattle, Wash. 98199; Michael L. Kingsley, 14026 - 81st Pl. NE.; Bernard A. Pearson, 16305 - 88th Ave. NE., both of Bothell, Wash. 98011

[21] Appl. No.: 579,423

[22] Filed: Feb. 13, 1984

[51] Int. Cl.[4] ..... B65H 29/58

[52] U.S. Cl. ..... 271/296; 271/290

[58] Field of Search ..... 271/296, 270, 290

[56] References Cited

U.S. PATENT DOCUMENTS

| | | | |
|---|---|---|---|
| 4,068,838 | 1/1978 | Anbergen | 271/296 |
| 4,273,326 | 6/1981 | Snellman | 271/296 X |
| 4,449,706 | 5/1984 | Snellman | 271/290 |

*Primary Examiner*—Richard A. Schacher
*Assistant Examiner*—O. Brown
*Attorney, Agent, or Firm*—Seed and Berry

[57] ABSTRACT

A sheet deflector drive for driving a sheet-delivering deflector between a plurality of vertically stacked paper-receiving shelves, including a pair of deflector carrying belts for moving the deflector between the shelves; a rotatable drive shaft for driving the belts to move the deflector, rotation of the shaft in one direction moving the deflector upward and rotation of the shaft in the other direction moving the deflector downward; a bidirectional drive motor selectively engageable with the shaft for rotating the shaft to one or the other rotational direction; a cam connected to the shaft for rotation therewith and having three radially projecting lobes, the lobes having an angular spacing therebetween corresponding to the rotational movement of the shaft necessary to move the deflector from a sheet-delivering position adjacent to one of the shelves to such a position adjacent to an immediately neighboring one of the shelves; a pivoted cam follower arm biased toward the cam for engaging the lobes, the follow arm rotating the shaft upon disengagement of the motor to bring the follow arm into simultaneous engagement with two of the lobes, the cam and follower arm being aligned with the shaft to position the deflector in a sheet delivery position adjacent to one of the shelves when the follower arm engages the two lobes; and a selectively operable brake having an engagement member for moving into frictional contact with a free end of the follower arm when the brake is applied, the brake holding the engagement member in frictional contact with the free end with a force permitting movement of the follower arm away from the cam under the influence of the lobes, but sufficient to hold the follower arm at substantially the farthest distance the lobes move the follower arm from the cam. The release of the brake moves the engagement member substantially out of frictional contact with the free end to permit the biasing of the follower arm to move the arm toward the cam and to engagement therewith for positioning of the deflector.

18 Claims, 6 Drawing Figures

SHEET DEFLECTOR AND CONVEYOR DRIVE

DESCRIPTION

1. Technical Field

The present invention relates generally to a sorting device of the vertical conveyor, single-deflector type, and more particularly, to an improved sheet deflector and conveyor drive.

2. Background Art

In sheet-sorting devices, such as collators and the like, sheets of paper are delivered on a vertical sheet-carrying conveyor to a plurality of vertically stacked, sheet-receiving shelves. A sheet-delivering deflector is typically carried by belts and travels vertically, positioned between the sheet-carrying conveyor and the sheet-receiving shelves to deflect a downwardly moving sheet carred by the conveyor into a preselected shelf.

For high-speed sorting, it is important that the deflector travel quickly, accurately and quietly from a sheet delivery position adjacent to one shelf to a sheet delivery position adjacent to another shelf. This is a particularly difficult problem when the shelves selected for delivery of successive sheets do not immediately neighbor one another, such as when the deflector must move past many shelves not receiving a sheet or move from the lower shelf of the vertical stack to the upper shelf to receive a new series of sheets. It is also important that the deflector be accurately aligned with the shelf and stabilized when in a sheet delivery position for delivery of a sheet.

The sheet-sorting device may include several towers of vertically stacked, sheet-receiving shelves, each of which is delivered sheets by a separate sheet-carrying conveyor. If the device has not been recently operating and the conveyors have been stationary, the flexible belts or tapes comprising the conveyors take on a set, particularly in the areas where they bend around guide and drive rollers, and assume a curvature conforming to the shape of the rollers. In such a condition, the motor used to drive the conveyors must have sufficient power to overcome the set, even though once the conveyor belts are moving, the power required for operation is significantly reduced.

It will therefore be appreciated that there has been a need for a sheet-sorting device that provides accurate and stable alignment of the sheet deflector with the sheet-receiving shelves, and quick, accurate and quiet travel of the sheet deflector between shelves. The device should also have a motor drive arrangement for the sheet-carrying conveyors which overcomes the power discrepancy problems associated with initial startup and subsequent operation. The present invention fulfills this need and further provides other related advantages.

DISCLOSURE OF INVENTION

The present invention resides in a sheet-carrying belt drive and a deflector drive for a sheet-sorting device having at least one tower with vertically stacked paper receiving shelves, a sheet-carrying belt to deliver sheets to the stack, and a sheet deflector to deflect sheets carried by the belt to selected ones of the shelves. More specifically, the sheet deflector drive of the present invention drives a sheet delivering deflector between a plurality of vertically stacked paper receiving shelves, and includes at least one deflector-carrying belt for moving the deflector between the shelves; a rotatable drive shaft for driving the belt to move the deflector, rotation of the shaft in one direction moving the deflector upward and rotation of the shaft in the other direction moving the deflector downward; a drive motor selectively engagable with the shaft for rotating the shaft in one or the other rotational direction; a cam connected to the shaft for rotation therewith; a cam follower mounted for biased engagement with the cam, the follower rotating the shaft upon disengagement of the motor to position the deflector in an aligned and stable sheet delivery position adjacent to each of the shelves; and biasing means for biasing the cam follower towards the cam to rotate the shaft upon disengagement of the motor. The drive further includes means responsive to the positioning of the cam relative to the follower for selectively disengaging the motor from the shaft to place the deflector substantially in a sheet delivery position adjacent to one of the shelves for receiving a sheet, the cam follower providing final indexed alignment and holding the deflector stable in the sheet delivery position; means for selectively engaging the motor with the shaft for removing the deflector to another one of the shelves to receive the next sheet; and means for selectively disengaging the cam and the follower for moving the deflector between distant ones of the shelves.

The cam is mounted on the shaft for rotation therewith and has at least three radially projecting lobes for engaging the follower. The angular spacing between the lobes corresponds to the rotation of the shaft necessary to move the deflector from one sheet delivery position adjacent to one of the shelves to another sheet delivery position adjacent to an immediately neighboring one of the shelves. The follower includes an arm for engaging the lobes and rotating the shaft under the influence of the biasing means when the drive motor is disengaged until the arm simultaneously engages two of the lobes, the arm positioning the deflector in the sheet delivery position when the arm engages two lobes. The lobes have rollers mounted thereon for engagement with the follower arm.

The drive motor is a bidirectional motor. The means for disengaging the cam from the follower arm is a selectively operable brake. The brake permits movement of the follower arm away from the cam by the lobes, but restricts movement back towards the cam until the brake is released. The follower arm is pivotally mounted for movement away from the cam by the lobes and has a free end. The brake has an engagement member for which is moved into frictional contact with the free end when the brake is applied. The brake holds the engagement member in frictional contact with the free end with a force permitting movement of the follow arm away from the cam under the influence of the lobes, but sufficient to hold the follow arm at substantially the farthest distance the lobes move the follow arm from the cam. Releasing the brake moves the engagement member substantially out of frictional contact with the free end to permit the biasing means to move the follow arm toward the cam and into engagement therewith with positioning with the deflector. The biasing means is a spring resiliently holding the follower arm in engagement with the cam.

The engagement member is moved into and out of frictional contact with the free end by a solenoid actuated in response to a signal indicating movement of the deflector will be between distant ones of the shelves.

The lobes of the cam have equal angular spacing therebetween, and extend an equal radial distance from the shaft to which the cam is mounted.

Means are also provided for determining the position of the deflector relative to the shelves by counting rotations of the cam. The means for selectively engaging the motor includes means for sensing passage of the sheets into the shelves and generating a sheet entry indicator signal. The means responses to the positioning of the cam generates a deflector position indicating signal. Clutch means are provided responsive to the sheet entry signal for engaging the motor with the shaft, and responsive to the deflector position indicating signal for disengaging the motor from the shaft.

The sheet-carrying belt drive of the invention includes a single variable-speed motor for driving each one of the sheet-carrying belts of the sheet-sorting device when it has a plurality of towers; and control means for sensing the speed of the variable-speed motor and comparing the speed to a preselected speed. The control means further generates a control signal to the variable-speed motor to maintain the motor substantially at the preselected speed both during the initial start-up period to overcome belt set and thereafter. In the presently preferred embodiment of the invention, the variable-speed motor is powered by direct current.

Other features and advantages of the invention will become apparent from the following detailed description, taken in conjunction with the accompanying drawings.

BEST MODE FOR CARRYING OUT THE INVENTION

Figure 1:
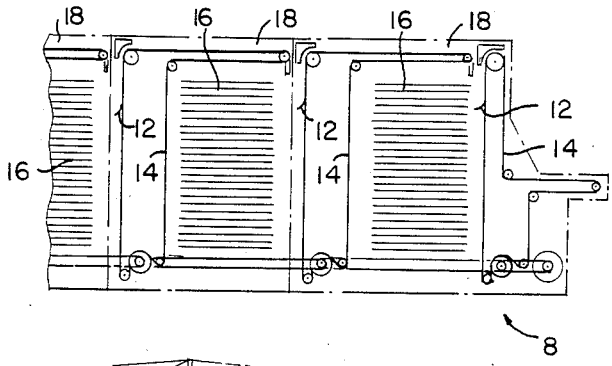
FIG. 1 is a side elevational view of a sorter embodying the present invention, showing a plurality of towers containing vertically stacked shelves.
Figure 2:
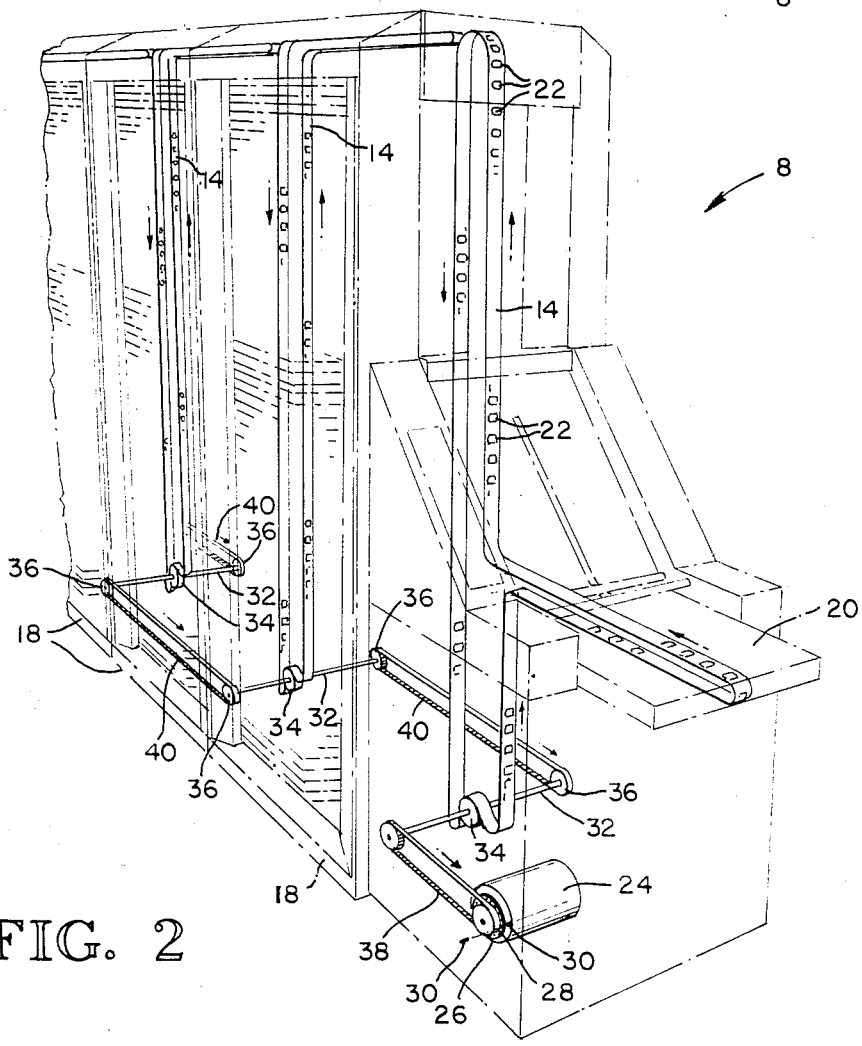
FIG. 2 is a fragmentary isomertric view of the sorter of FIG. 1, showing a sheet-carrying conveyor tape drive arrangement.
Figure 3:
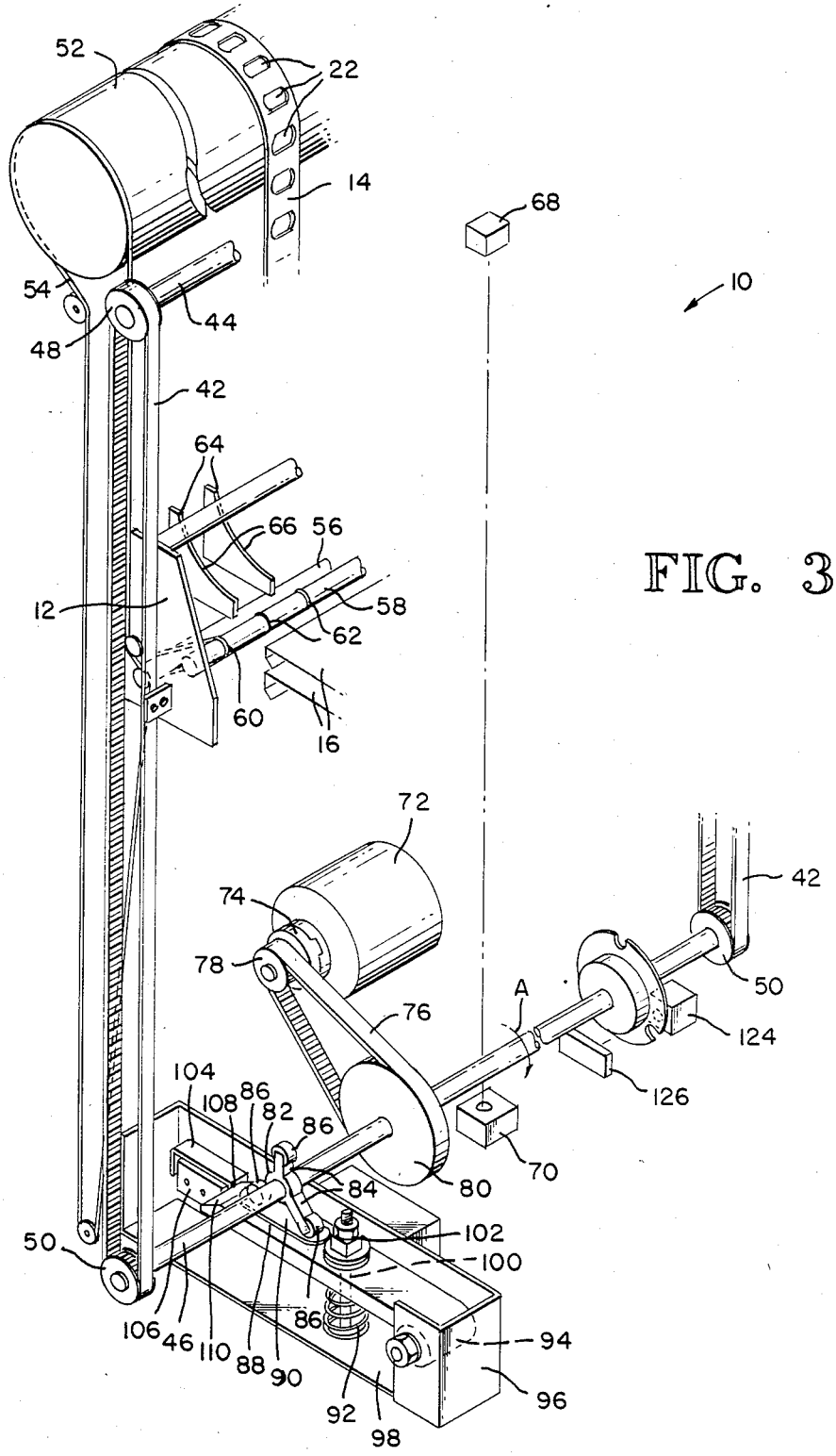
FIG. 3 is a fragmentary isometric view of a sheet deflector drive for one tower of the sorter of FIG. 1.

As shown in the drawings for purposes of illustration, the present invention is embodied in a sheet-sorting device, indicated generally by reference numeral 8. As shown in FIG. 3, the sorting device 8 has a deflector drive 10 including a vertically movable sheet deflector 12 which deflects sheets of paper or other suitable sheet material carried on a vertically oriented, endless, sheet-carrying conveyor tape 14 to a plurality of vertically stacked, sheet-receiving shelves or bins 16. The sorting device 8 provides control signals to the deflector drive 10 for selecting which shelf 16 the deflector 12 is to deflect a sheet, and then to which shelf the deflector is to travel for deflection of the next sheet. As shown in FIGS. 1 and 2, the sorting device 8 may be manufactured with a plurality of towers or modules 18 of vertically stacked, sheet-receiving shelves 16, each supplied sheets by its own deflector 12 controlled by its own deflector drive 10.

The sorting device 8 has a table 20 wherein sheets to be sorted are deposited by a printer, copier, or other sheet delivering machine (not shown). The sheet-carrying conveyor tape 14 for the frist tower 18 carries the deposited sheet from the table 20 to the deflector 12 of the first tower (not shown in FIG. 2) for insertion into a preselected shelf 16, or onto the conveyor tape 14 for the second tower. In like fashion, the conveyor tape 14 for the second tower 18 delivers the sheet to the deflector 12 of the second tower for insertion into a preselected shelf 16, or onto the conveyor tape 14 for the third tower, and so on. The sheet-carrying conveyor tape 14 has a plurality of apertures 22 therethrough, and a vacuum plenum (not shown) associated therewith for application of a vacuum to hold the sheets to the tape during transport.

The sorting device 8 has a single direct-current (D.C.) electric motor 24 contained within the base compartment of the first tower to drive the sheet-carrying conveyor tape 14 for all towers 18. Also provided for control of the rotational speed of the D.C. motor 24 is a disc 26 having a plurality of circumferentially equispaced apertures 28 mounted on the output shaft of the motor 24 for rotation therewith. A light source and sensor pair 30 is mounted with the disc 26 therebetween for sensing the rotational speed of the motor 24 and generating a speed indicator signal. Based upon the speed indicator signal, the D.C. motor 24 is supplied more or less direct current to maintain the motor at a constant rotational speed, and hence, the conveyor tapes 14 for all towers 18 travel at a substantially constant speed at all times. The selection of the D.C. motor 24 over the conventional alternating current motor allows use of a motor which may be speeded up during an initial start-up period by application of more electrical power when the conveyor tape 14 requires more power to start it moving and overcome the belt set which takes place if the conveyor tape has been sitting still and assumed stiff bends conforming to the shape of its support rollers. The operating power requirements of the D.C. motor 24 to maintain the desired rotational speed decreases once beyond the start-up period, and the power supplied is automatically reduced, resulting in a more energy efficient operation and reduced cost of operation. Additionally, the use of the D.C. motor 24 allows the precise operating speed of the conveyor tape 14 to be selectively adjusted to match the operating speed of the printer, copier, or other sheet-delivering machine with which the sorting device 8 is used. This results in longer part life since the sorting device 8 is not operated at unnecessarily excessive speeds at which greater wear of the moving parts occurs.

The conveyor tape 14 for each of the towers 18 is provided with a horizontally oriented drive shaft 32 and a tape-driving sheave 34 attached along its midsection for driving the conveyor tape. At each end of the drive shaft 32 is a shaft driving sheave 36. For the first of the towers 18, the D.C. motor 24 is connected to the left-end sheave 36 of the drive shaft 32 by an endless drive belt 38. The right-end sheave 35 of the drive shaft 32 is provided for easy attachment of another endless drive belt 40 for driving the drive shaft 32 of the second tower, if the sorting device 8 has a second tower 18. Supplying drive to the drive shaft 32 for any additional tower 18 which is added may be accomplished simply by attaching one of the drive belts 40 to the free left- or right-end sheave 35 of the preceding tower and the corresponding drive shaft sheave of the tower being added. This allows a modular approach, permitting easy addition of additional towers 18 as the user's requirements increase with minimum expense and disturbance of the existing sheet-sorting device components.

As best shown in FIG. 3, the deflector 12 is attached at both of its ends to one of a pair of endless deflector-carrying belts 42. The deflector belts 42 are supported by a horizontally oriented upper idler shaft 44 and a horizontally oriented lower drive shaft 46. Each of the deflector belts 42 extends between and rides on two pulleys 48 and 50 mounted to the ends of the shafts 44 and 46, respectively. Drive is provided to the belts 42 by the lower drive shaft 46.

The sheet-carrying conveyor tape 14 passes over a relatively large diameter idler roller 52 and, as previously discussed, is imparted movement for the carrying of sheets by the drive sheave 34 (see FIG. 2). The movement of the conveyor tape 14 rotates the idler roller 52 and drives a round endless friction belt 54. The belt 54 is used to rotate a pair of deflector rollers 56 and 58, interconnected by a belt 60 and comprising part of the deflector 12. The deflector roller 56 has several O-rings 62 mounted thereon at spaced-apart positions along its length which grab a passing sheet and provide it with an impulse force to aid in its delivery to one of the shelves 16.

The deflector 12 has a plurality of parallel deflecting fingers 64 designed to provide a deflection surface 66 to engage and deflect a sheet carried on the conveyor tape 14 into one of the shelves 16 when placed in a sheet delivery position adjacent to the shelf. Alternatively, the deflector 12 may be manufactured with a solid deflection surface. A photoelectric light source 68 and a cooperating light-sensitive receiver 70 are positioned with the light source directing a generally vertical beam of light between the deflector 12 and the stacked shelves 16 to detect passage of a sheet into a shelf and generate a sheet entry indicator signal.

The sheet deflector drive 10 further includes a bidirectional motor 72 for providing rotational drive to the lower drive shaft 46. Rotation of the drive shaft 22 in the clockwise direction, indicated by the letter "A," moves the deflector 12 downward; and rotation in the counterclockwise direction moves the deflector upward. The motor 72 has a clutch 74 attached to its output shaft for selective application of the rotational drive to the drive shaft 46. The drive is applied by the motor 72 through an endless drive belt 76 mounted on a sheave 78 attached to the clutch 74 and extending around a relatively large diameter sheave 80 fixedly attached to the drive shaft 46.

Also fixedly attached to the drive shaft 76 for rotation therewith is a cam 82 having three radially projecting arms or lobes 84 with an equal angular spacing between the arms of 120 degrees. Each of the arms 84 carries at its free, remote end a freely rotatable roller 86. The angular spacing between the arms 84 corresponds to the rotational movement of the drive shaft 46 necessary to move the deflector 12 from a sheet delivery position adjacent to one of the shelves 16 to a sheet delivery position adjacent to an immediately neighboring one of the shelves. In an alternative embodiment of the cam 82 not shown, the cam is manufactured with a triangular body, with or without rollers attached to the three lobes.

Positioned below the cam 82 for engaging the cam rollers 86 is a flat, elongated cam follower arm 88. A striker plate 90 is mounted on the upper surface of the cam follower arm 88 for contact with the cam rollers 86. The follower arm 88 is biased into engagement with the cam 82 by a compression spring 92. The cam follower arm 88 and the cam 82 are oriented with respect to the drive shaft 46 to position the deflector 12 in a sheet delivery position adjacent to one shelf 16 when the follower arm simultaneously engages two cam rollers 86. The use of two simultaneously engaged cam rollers 86 engaging the flat follower arm 88 provides an accurate, self-centering means for alignment of the deflector 12, which is stable and allows precise positioning of the cam 82 and follower arm relative to each other.

The cam follower arm 88 is pivotally mounted at one end 94 to a support frame 96. The biasing spring 92 is positioned under compression between a horizontally extending flange 98 of the frame 96 and the cam follower arm 88, and is held in place by a bolt 100. The bolt 100 maintains alignment of the spring 92 and a pair of lockable nuts 102 threaded onto the bolt provides for an end-limit adjustment of the travel of the cam follower arm 88 toward the cam 82 under the force of the spring 92.

The sheet deflector drive 10 of the present invention also includes a follower arm brake 104. The brake 104 is selectively operable in response to a signal from the sorting device 8, or the printer or other device with which the sorting device is used, indicating that the deflector 12 is to travel from its present position to a new position which requires it to pass by a preselected number of shelves 16. In such a situation, it is advantageous to disengage the cam 82 from the cam follower arm 88 to reduce drag on the drive shaft 46 and permit a quicker and more responsive movement of the deflector 12. Disengaging the cam 82 also reduces the noise produced by the cam rollers 86 striking the striker plate 90, and reduces part wear.

Figure 4:
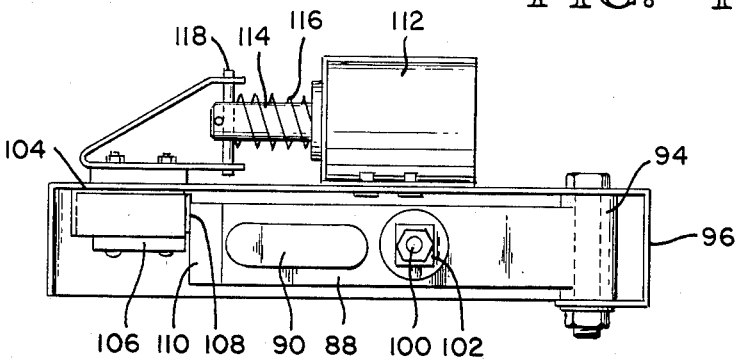
FIG. 4 is an enlarged top view of the brake mechanism shown in FIG. 3.
Figure 5:
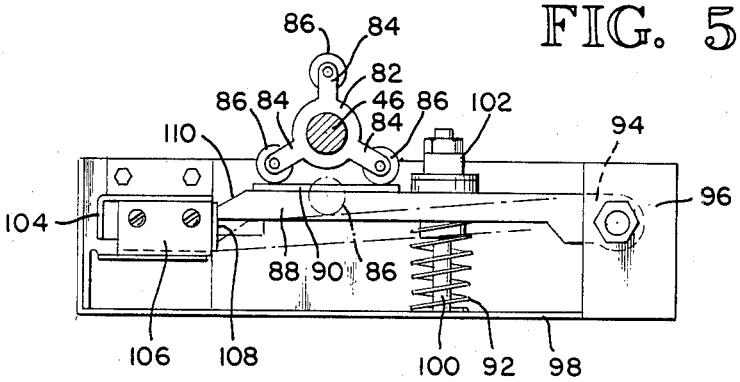
FIG. 5 is a side elevational view of the brake mechanism shown in FIG. 4, with a cam roller shown in phantom positioned dead-center over a follower arm.
Figure 6:
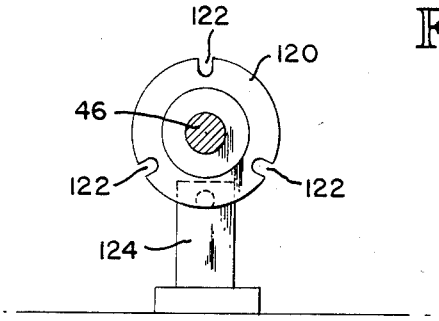
FIG. 6 is an enlarged side elevational view of the light disc shown in FIG. 3.

As shown in FIGS. 4 and 5, the brake 104 includes a movable member 106 to which is attached a friction pad 108. The movable member 106 is slidably mounted to the support frame 96 and movable toward and away from the cam follower arm 88 to place the friction pad 108 into and out of frictional contact with a free end 110 of the cam follower arm 88 remote from the pivoted end 94 of the arm. When the brake 104 is not applied, and the friction pad 108 is moved out of contact with the free end 110, the cam follower arm 88 is permitted to freely pivot about its pivoted end 94 in response to the rotation of the cam rollers 86 and the action of the biasing spring 92 as the cam 82 rotates with the driven shaft 46. When the bake 104 is applied, the friction pad 108 is moved into frictional contact with the free end 110 and the pad prevents the return travel of the follower arm 88 toward the cam 82 under the influence of the spring 92.

As the cam 82 rotates from a position in which two of the cam rollers 86 are simultaneously engaging the follower arm 88, the follower arm is pushed in a direction away from the cam by one of the cam arms 84 to a distance equal to the length of the arm. The cam 82 is at that moment in a position where the cam arm 84 is dead-center over the follower arm 88 and is oriented substantially perpendicular to the follower arm. If the cam 82 continues to rotate at least slightly beyond dead-center and then the clutch 74 is disengaged removing the drive of motor 72 from the drive shaft 46, and if the brake 104 is not applied, the spring 92 will force the follower arm 88 to move in a direction toward the cam and to rotate the cam until the cam is in a rotational position with two of the cam rollers 86 simultaneously engaging the follower arm. This accurately places and holds the deflector 12 in a stable sheet delivery position. By the use of two cam contacts and a flat follower, the usual inaccuracies of cam indexed positioning resulting from the follower rolling or moving relative to the cam and not being precisely positionable relative to each other is eliminated.

When the brake 104 is applied, the movable member 106 is moved toward the follower arm 88 to place the friction pad 108 into engagement with the free end 110 of the follower arm with a force which permits the above-described movement of the follower arm in a direction away from the cam 82 under the influence of the rotating cam arms 84, but which is sufficient to hold the follower arm at substantially the farthest distance to which the cam arms moves the follower arm from the cam. When the follower arm 88 is so held by the brake 104, the cam rollers 86 will just touch the follower arm 88 as the cam 82 rotates, but will not have to overcome the spring force of the spring 92 which usually biases the follower arm into engagement with the cam and will not make a solid strike against the striker pad 90. Consequently, the drag which the cam 82 and follower arm 88 normally place on the drive shaft 46 is substantially removed, and the noise created by their operation is substantially eliminated until the brake 104 is released.

The movement of the movable member 106 carrying the friction pad 72 is controlled by a solenoid 112. The solenoid 112 has a reciprocating plunger 114 biased to return to an extended position by a spring 116. The plunger 114 is connected to the movable member 106 through a wrist pin 118. In response to a signal indicating the deflector 12 is to be moved over more than one shelf position, the solenoid 112 is activated and the plunger 114 is retracted. The retraction of the plunger 114 pulls the member 106 toward the follower arm 88, and thereby pulls the friction pad 108 into the desired frictional contact with the free end 110 of the follower arm. When the solenoid 112 is deactivated, the plunger 114 extends under the influence of the spring 116, moving the member 106 away from the follower arm 88 and the friction pad 108 out of engagement with the free end 110.

A disc 120 is attached to the drive shaft 46 for rotation therewith, and has three equally spaced apertures 122 positioned about its perimeter. A photoelectric light source 124 and a cooperating light-sensitive receiver 126 are positioned to each side of the disc 120, with the light source directing a beam of light toward the disc in alignment with the apertures 122. The light beam is blocked by the disc 120 except when the drive shaft 46 rotates the disc into a position with one of the apertures 122 coincident with the beam of light, whereat the beam is completed and a clutch disengagement signal is generated for disengagement of the clutch 74. The clutch disengagement signal causes removal of the drive of the motor 72 from the drive shaft 46 (subject to receipt of a signal indicating the next sheet is to be delivered to the shelf 16 being next approached by the deflector 12). The angular alignment of the disc 120 on the drive shaft 46 and the number of apertures 122 provided on the disc 120 is set with relation to the positions of the cam 82 relative to the follower arm 88. In particular, the aperture alignment is selected to produce a clutch disengagement signal during the rotational travel of the cam 82 each time one of the cam arms 84 passes over dead-center relative to the follower arm 88, but before the next occasion two cam rollers 86 simultaneously engage the follower arm.

With such an alignment, the clutch disengagement signal is timed to disengage the motor 72 from driving the drive shaft 46 and thereby allow the spring force of the spring 92 applied through the follower arm 88 to the cam 82 to rotate the cam into the next position, with two cam rollers 86 simultaneously engaging the follower arm. As previously discussed, with the cam 82 in this position the deflector 12 is placed in a sheet delivery position adjacent to one of the shelves 16.

Since the motor 72 has been disengaged during this final adjustment of the positioning of the deflector 12 by the cam 82 and follower arm 88, and since the cam positioned with two cam rollers 86 engaging the follower arm is an inherently stable resting position for the cam, precise positioning of the deflector is possible without the motor overdriving the deflector and misaligning it with the shelves 16. For the three-arm cam 82 of the presently preferred embodiment of the invention, the cam has three stable rest positions angularly offset from each other by the amount of rotation of the drive shaft 46 required to move the deflector 12 from one shelf 16 to the next.

The motor 72 is once again engaged by the clutch 74 upon receiving a clutch engagement signal which is generated in response to the sheet entry indicator signal of the light source and receiver 68 and 70 indicating the deflector 12 has successfully diverted a sheet into one of the shelves 16. The motor 72 drives the drive shaft 46 until the next clutch disengagement signal is received.

In addition to use for generating clutch disengagement signals, the number of times the apertures 122 of the disc 120 allow completion of the light beam is counted to track the positioning of the deflector 12 relative to the vertically stacked shelves 16. Each time one of the apertures 122 passes through the light beam, it indicates the drive shaft 46 has rotated sufficiently to move the deflector 12 from one shelf to the next, whether or not the drive motor 72 is engaged, or the brake 104 is applied, or the cam 82 is disengaged from the cam follower arm 88.

The deflector drive 10 has been described heretofore with respect to a single vertical stack of paper-receiving shelves 16. It is to be understood, however, that the sorting device 8 may have a plurality of such stacks of shelves 16, each stack being served by its own deflector 12 using a deflector drive 10 of the present invention. The device 8 would include a single, individually controlled, bidirectional motor 72 for each stack.

It will also be appreciated that, although a specific embodiment of the invention has been described herein for purposes of illustration, various modifications may be made without departing from the spirit and scope of the invention. Accordingly, the invention is not limited except as by the appended claims.

We claim:

1. A sheet deflector drive for driving a sheet-delivering deflector between a plurality of vertically stacked paper-receiving shelves, comprising:

at least one deflector-carrying belt for moving said deflector between said shelves;

a rotatable drive shaft for driving said belt to move said deflector, rotation of said shaft in one direction moving said deflector upward and rotation of said shaft in the other direction moving said deflector downward;

a bidirectional drive motor selectively engageable with said shaft for rotating said shaft in one or the other rotational direction;

a cam connected to said shaft for rotation therewith and having at least three radially projecting lobes, said lobes having an angular spacing therebetween corresponding to the rotational movement of said shaft necessary to move said deflector from a sheet delivery position adjacent to one of said shelves to a sheet delivery position adjacent to an immediately neighboring one of said shelves;

a cam follower arm biased toward said cam for engaging said lobes, said follower arm rotating said shaft upon disengagement of said motor to bring said follower arm into simultaneous engagement with two of said lobes, said cam and said follower arm being aligned with said shaft to position said deflector in a sheet delivery position adjacent to one of said shelves when said follower arm engages said two lobes;

means for sensing positioning of said cam relative to said follower arm for selectively disengaging said motor from said shaft to place said deflector substantially in a sheet delivery position adjacent to a predetermined one of said shelves for final alignment and stabilization by said cam and said follower arm interaction;

means for sensing passage of sheets into said shelves and generating a sheet entry indicator signal to selectively engage said motor with said shaft for moving said deflector to a predetermined another one of said shelves to receive the next sheet; and means for selectively disengaging said cam and said follower arm for movement of said deflector between distant ones of said shelves.

2. A sheet deflector drive for driving a sheet-delivering deflector between a plurality of vertically stacked paper-receiving shelves, comprising:

at least one deflector-carrying belt for moving said deflector between said shelves;

a rotatable drive shaft for driving said belt to move said deflector, rotation of said shaft in one direction moving said deflector upward and rotation of said shaft in the other direction moving said deflector downward;

a drive motor selectively engageable with said shaft for rotating said shaft in one or the other rotational direction;

a cam connected to said shaft for rotation therewith;

a cam follower mounted for biased engagement with said cam, said follower rotating said shaft upon disengagement of said motor to position said deflector in an aligned and stable sheet delivery position adjacent to each of said shelves;

biasing means for biasing said cam follower toward said cam to rotate said shaft upon disengagement of said motor;

means responsive to the positioning of said cam relative to said follower for selectively disengaging said motor from said shaft to place said deflector substantially in a sheet delivery position adjacent to one of said shelves for receiving a sheet, said cam follower providing final indexed alignment and holding said deflector stable in said sheet delivery position;

means for selectively engaging said motor with said shaft for moving said deflector to another one of said shelves to receive the next sheet; and means for selectively disengaging said cam and said follower for moving of said deflector between distant ones of said shelves.

3. The sheet deflector drive of claim 2 wherein said cam is mounted on said shaft for rotation therewith and has at least three radially projecting lobes for engaging said follower, the angular spacing between said lobes corresponding to the rotation of said shaft necessary to move said deflector from one sheet delivery position adjacent to one of said shelves to another sheet delivery position adjacent to an immediately neighboring one of said shelves, and said follower includes an arm for engaging said lobes and rotating said shaft under the influence of said biasing means when said motor is disengaged until said arm simultaneously engages two of said lobes, said arm positioning said deflector in said sheet delivery position when said arm engages said two lobes.

4. The sheet deflector drive of claim 3 wherein said lobes have rollers mounted thereon for engagement with said follower arm.

5. The sheet deflector drive of claim 3 wherein said means for disengaging said cam and said follower arm includes a selectively operable brake, said brake permitting movement of said follower arm away from said cam by said lobes but restricting movement back toward said cam until said brake is released.

6. The sheet deflector drive of claim 5 wherein said follower arm is pivotally mounted for movement away from said cam by said lobes and has a free end, and said brake has an engagement member for moving into frictional contact with said free end when said brake is applied, said brake holding said engagement member in frictional contact with said free end with a force permitting movement of said follower arm away from said cam under the influence of said lobes, but sufficient to hold said follower arm at substantially the farthest distance said lobes move said follower arm from said cam, releasing said brake moving said engagement member substantially out of frictional contact with said free end to permit said biasing means to move said follower arm toward said cam and into engagement therewith for positioning of said deflector.

7. The sheet deflector drive of claim 6 wherein said biasing means is a spring resiliently holding said follower arm in engagement with said cam.

8. The sheet deflector drive of claim 6 wherein said engagement member is moved into and out of frictional contact with said free end by a solenoid actuated in response to a signal indicating movement of said deflector between distant ones of said shelves.

9. The sheet deflector drive of claim 3 wherein said lobes have equal angular spacing therebetween, and extend an equal radial distance from said shaft.

10. The sheet deflector drive of claim 3, further including means for determining the position of said deflector relative to said shelves by counting rotations of said cam.

11. The sheet deflector drive of claim 3 wherein said means for selectively engaging said motor includes means for sensing passage of sheets into said shelves and generating a sheet entry indicator signal, and wherein said means responsive to positioning of said cam generates a deflector position indicator signal.

12. The sheet deflector drive of claim 11, further including clutch means responsive to said sheet entry indicator signal for engaging said motor with said shaft, and responsive to said deflector position indicator signal for disengaging said motor from said shaft.

13. A sheet deflector drive for driving a sheet-delivering deflector between a plurality of vertically stacked paper-receiving shelves, comprising:

at least one deflector-carrying belt for moving said deflector between said shelves;

a rotatable drive shaft for driving said belt to move said deflector, rotation of said shaft in one direction moving said deflector upward and rotation of said shaft in the other direction moving said deflector downward; 'a bidirectional drive motor selectively engageable with said shaft for rotating said shaft in one or the other rotational direction;

a cam connected to said shaft for rotation therewith;

a cam follower mounted for biased engagement with said cam, said follower rotating said shaft upon disengagement of said motor to position said deflector in an aligned and stable sheet delivery position adjacent to each of said shelves;

biasing means for biasing said cam follower toward said cam to rotate said shaft upon disengagement of said motor;

a positioning sensor responsive to the positioning of said cam relative to said follower for selectively disengaging said motor from said shaft to place said deflector substantially in a sheet delivery position adjacent to one of said shelves for receiving a sheet, said cam follower providing final indexed alignment and holding said deflector stable in said sheet delivery position;

a clutch for selectively engaging said motor with said shaft for moving said deflector to another one of said shelves to receive the next sheet; and a selectively operable brake for disengaging said cam and said follower for moving of said deflector between distant ones of said shelves, said brake frictionally engaging said cam follower upon application of said brake to retain said cam follower at a distance from said cam to which said cam follower is moved by said cam.

14. The sheet deflector drive of claim 13 wherein said cam is mounted on said shaft for rotation therewith and has at least three radially projecting lobes for engaging said follower, the angular spacing between said lobes corresponding to the rotation of said shaft necessary to move said deflector from one sheet delivery position adjacent to one of said shelves to another sheet delivery position adjacent to an immediately neighboring one of said shelves, and said follower includes an arm for engaging said lobes and rotating said shaft under the influence of said biasing means when said motor is disengaged until said arm simultaneously engages two of said lobes, said arm positioning said deflector in said sheet delivery position when said arm engages said two lobes.

15. The sheet deflector drive of claim 13 wherein said cam follower includes a follower arm pivotally mounted for movement away from said cam, said arm being pivoted at one end and having a free end, and said brake has an engagement member for moving into frictional contact with said free end when said brake is applied, said brake holding said engagement member in frictional contact with said free end with a force permitting pivotal movement of said follower arm away from said cam under the influence of said cam, but sufficient to hold said follower arm at substantially the farthest distance said cam moves said follower arm, releasing said brake, moving said engagement member substantially out of frictional contact with said free end to permit said biasing means to move said follower arm toward said cam and into engagement therewith for positioning of said deflector.

16. The sheet deflector drive of claim 15 wherein said engagement member is moved into and out of frictional contact with said free end by a solenoid actuated in response to a signal indicating movement of said deflector between distant ones of said shelves.

17. A sheet-sorting device having a plurality of towers of vertically stacked paper-receiving shelves, with a sheet-carrying belt for each stack to deliver sheets thereto and a sheet deflector for each stack to divert sheets carried by the belts to selected ones of the shelves, the device having a sheet-carrying belt drive, comprising:

a single variable-speed motor for driving each one of said sheet-carrying belts; and control means for sensing the speed of said variable-speed motor and comparing said speed to a preselected speed, said control means further generating a control signal to said variable-speed motor to maintain said motor substantial at said preselected speed both during the initial start-up period to overcome belt set and thereafter; and each tower of the device having a deflector drive, comprising:

a. at least one deflector-carrying belt for moving said deflector between said shelves;

b. a rotatable drive shaft for driving said belt to move said deflector, rotation of said shaft in one direction moving said deflector upward and rotation of said shaft in the other direction moving said deflector downward;

c. a drive motor selectively engageable with said shaft for rotating said shaft in one or the other rotational direction;

d. a cam connected to said shaft for rotation therewith;

e. a cam follower mounted for biased engagement with said cam, said follower rotating said shaft upon disengagement of said motor to position said deflector in an aligned and stable sheet delivery position adjacent to each of said shelves;

f. biasing means for biasing said cam follower toward said cam to rotate said shaft upon disengagement of said motor;

g. means responsive to the positioning of said cam relative to said follower for selectively disengaging said motor from said shaft to place said deflector substantially in a sheet delivery position adjacent to one of said shelves for receiving a sheet, said cam follower providing final indexed alignment and holding said deflector stable in said sheet delivery position;

h. means for selectively engaging said motor with said shaft for moving said deflector to another one of said shelves to receive the next sheet; and i. means for selectively disengaging said cam and said follower for moving of said deflector between distant ones of said shelves.

18. The sheet-sorting device of claim 17 wherein said variable speed motor is powered by direct currect.

* * * * *